US009296538B2

(12) United States Patent
El-Afandi

(10) Patent No.: US 9,296,538 B2
(45) Date of Patent: Mar. 29, 2016

(54) FOIL MEMBRANE LID

(75) Inventor: Ali El-Afandi, Maplewood, MN (US)

(73) Assignee: General Mills, Inc., Minneapolis, MN (US)

( * ) Notice: Subject to any disclaimer, the term of this patent is extended or adjusted under 35 U.S.C. 154(b) by 1146 days.

(21) Appl. No.: 11/956,436

(22) Filed: Dec. 14, 2007

(65) Prior Publication Data

US 2008/0142521 A1 Jun. 19, 2008

Related U.S. Application Data

(60) Provisional application No. 60/869,952, filed on Dec. 14, 2006.

(51) Int. Cl.

| | |
|---|---|
| ***B65D 17/34*** | (2006.01) |
| ***B65D 77/20*** | (2006.01) |
| *B65D 17/00* | (2006.01) |

(52) U.S. Cl.

CPC ..... *B65D 77/20* (2013.01); *B65D 17/163* (2013.01); *B65D 17/165* (2013.01); *B65D 2205/02* (2013.01); *B65D 2577/2058* (2013.01)

(58) Field of Classification Search

CPC ..... B65D 77/20; B65D 2577/2058; B65D 2205/02; B65D 17/163; B65D 17/165

USPC ..... 220/257.1, 257.2, 266, 269, 270, 271, 220/273, 359.1, 359.2

See application file for complete search history.

(56) References Cited

U.S. PATENT DOCUMENTS

| | | | | | |
|---|---|---|---|---|---|
| 3,232,474 | A | * | 2/1966 | Dunn | 220/270 |
| 3,307,737 | A | * | 3/1967 | Harvey et al. | 220/271 |
| 3,383,008 | A | * | 5/1968 | Lipske | 220/270 |
| 3,401,824 | A | * | 9/1968 | Rouse | 220/273 |
| 3,434,622 | A | * | 3/1969 | Czegledy | 220/231 |
| 3,561,631 | A | * | 2/1971 | Hatfield et al. | 215/255 |
| 3,604,589 | A | * | 9/1971 | Fraze | 220/271 |
| 3,610,461 | A | * | 10/1971 | Allyn | 220/212 |
| 3,616,961 | A | * | 11/1971 | Mallorca | 220/269 |
| 3,795,341 | A | * | 3/1974 | Ostrem | 220/269 |
| 4,258,859 | A | * | 3/1981 | Westphal | 220/270 |
| 4,280,653 | A | * | 7/1981 | Elias | 229/123.1 |
| 4,501,375 | A | * | 2/1985 | Katsura et al. | 220/270 |
| 4,609,123 | A | * | 9/1986 | Poncy | 220/270 |
| 4,708,249 | A | | 11/1987 | Emslander et al. | |
| 4,834,259 | A | * | 5/1989 | Kubis et al. | 220/359.2 |
| 5,131,556 | A | * | 7/1992 | Iioka et al. | 220/270 |
| 5,145,086 | A | * | 9/1992 | Krause | 220/270 |
| 5,813,811 | A | * | 9/1998 | Saunders | 413/16 |
| 5,819,973 | A | * | 10/1998 | Traub et al. | 220/271 |
| 2005/0045633 | A1 | * | 3/2005 | Roeterdink et al. | 220/254.1 |

FOREIGN PATENT DOCUMENTS

EP 0379137 A1 7/1990

* cited by examiner

*Primary Examiner* — Fenn Mathew
*Assistant Examiner* — James N Smalley
(74) *Attorney, Agent, or Firm* — Diederiks & Whitelaw, PLC; Annette M. Frawley

(57) ABSTRACT

The invention includes a closure for a container. The closure includes a lid, a tab including a base, an end opposite the base, and a rivet. The rivet is disposed between the base and the end. The tab is fastened to the lid at the base and the rivet such that the rivet pulls away from the lid to form a hole in the lid when the end of the tab is moved away from the lid during the opening process.

15 Claims, 7 Drawing Sheets

FOIL MEMBRANE LID

CROSS-REFERENCE TO RELATED APPLICATIONS

This application claims the benefit of priority under 35 U.S.C. 119(e)(1) of a provisional patent application Ser. No. 60/869,952, filed Dec. 14, 2006, which is incorporated herein by reference in its entity.

FIELD OF THE INVENTION

The invention relates generally to the field of easy-to-open containers and receptacles, and more specifically to easy-to-open metal lids.

BACKGROUND OF THE INVENTION

Easy-to-open lids generally have a peripheral score, as in the case of containers for food products. Some lids also include a pull tab for tearing an opening in the container, through which the contents of the container can be accessed.

It is often desirable to seal liquids into containers while they are hot, or alternatively, to sterilize liquids by heating them in a sealed container. As the product cools, the containers and lids must have sufficient strength or deformation properties to enable the containers to accommodate the change in internal pressure, i.e. retort. Currently, retortable foil membrane double seam lids are used on vessels containing non-liquid high viscosity products. Some of these foil membrane lids also include a pull tab to facilitate the opening process.

Problems arise when these lids are used on vessels containing low viscosity products. For example, during the retort process, the initial expansion and subsequent contraction of the foil membrane lid could potentially leave the tab extended or otherwise exposed after a heated product has cooled. When this happens, there is a chance that the package can be opened during in-plant distribution—especially when the vessel is conveyed upside down. Moreover, when the lids are used to seal vacuum packed liquids, the pressure differential can cause a splashing effect when the package is opened.

Accordingly, there is a need for an improved retortable foil membrane double seam lid that can be easily opened while reducing the shortcomings set forth above.

SUMMARY OF THE INVENTION

The invention solves many of the problems associated with using retortable foil membrane seam lids on vessels containing low viscosity food products. By fastening at least one point on the tab to the main body of the membrane lid in such as way as to cause a hole to be generated when the end of the tab is lifting away from the lid, a user essentially creates a vent hole in the membrane. Additionally, the point on the tab that is fastened to the lid serves to tack the tab down to the body of the lid and reduces the chance of packages inadvertently opening during the in-plant distribution cycle.

Within the scope of the invention outlined above, the invention includes a closure for a container. The closure includes a lid, a tab including a base, an end opposite the base, and a rivet. The rivet is disposed between the base of the tab and the end of the tab. The tab is fastened to the lid at the base and the rivet such that the rivet pulls away from the lid to form a hole in the lid when the end of the tab is moved away from the lid during the opening process.

In an alternative embodiment, the invention includes a vessel for a food product. The vessel includes a container having a sidewall and a bottom. A lid is configured to attach to the container, thereby forming a seal. The vessel also includes a tab having a base, an end opposite the base, and a rivet disposed between the base of the tab and the end of the tab. The tab is fastened to the lid at the base and the rivet such that the rivet pulls away from the lid to form a hole in the lid when the end of the tab is moved away from the lid during the opening process.

In yet another alternative embodiment, the invention includes a method of preparing a package containing a food product. The method includes the steps of providing a vessel including a container having a sidewall and a bottom, a lid configured to attach to the container, and a tab including a base, an end opposite the base, and a rivet disposed between the base and the end. The tab is fastened to the lid at the base and the rivet such that the rivet pulls away from the lid to form a hole in the lid when the end of the tab is moved away from the lid during the opening process. The method also includes the steps of filling the container with a food product and hermetically sealing the lid to the container.

The above summary of the invention disclosed herein is not intended to describe each illustrated embodiment or every implementation of the invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
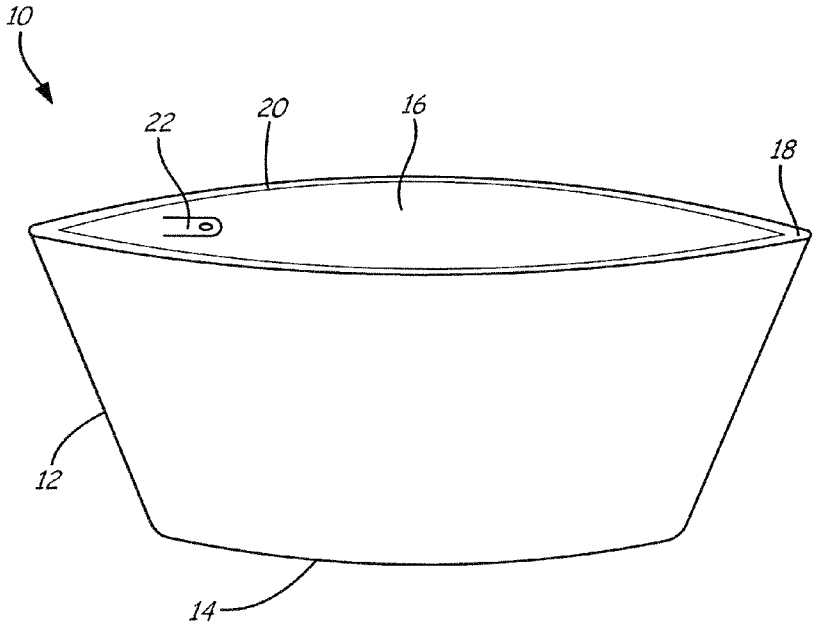
FIG. 1 is a side view of a container incorporating the foil membrane lid of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

The invention can be more readily understood by reference to FIGS. 1-7 and the following description. While the invention is not necessarily limited to such an application, the invention will be better appreciated using a discussion of example embodiments in such a specific context.

With reference to FIG. 1, container 10 is shown. Container 10 includes sidewall 12 and bottom 14. Container 10 also includes lid 16. Lid 16 includes a foil membrane lid in accordance with the invention. Lid 16 is configured to maintain a fluid inside container 10, even when the fluid is packed in a pressurized, or vacuum-packed condition. In one embodiment, lid 16 is deformable to allow the lid to flex in a convex or concave position with respect to the container.

End blank 18 is disposed between sidewall 12 and lid 16. In one embodiment, a score line 20 is disposed between end blank 18 and lid 16 to facilitate the opening of container 10. End blank 18 is preferably fabricated from a metal rim. In alternative embodiments, end blank 18 can be fabricated from non-rigid materials, including various polymers.

Figure 2:
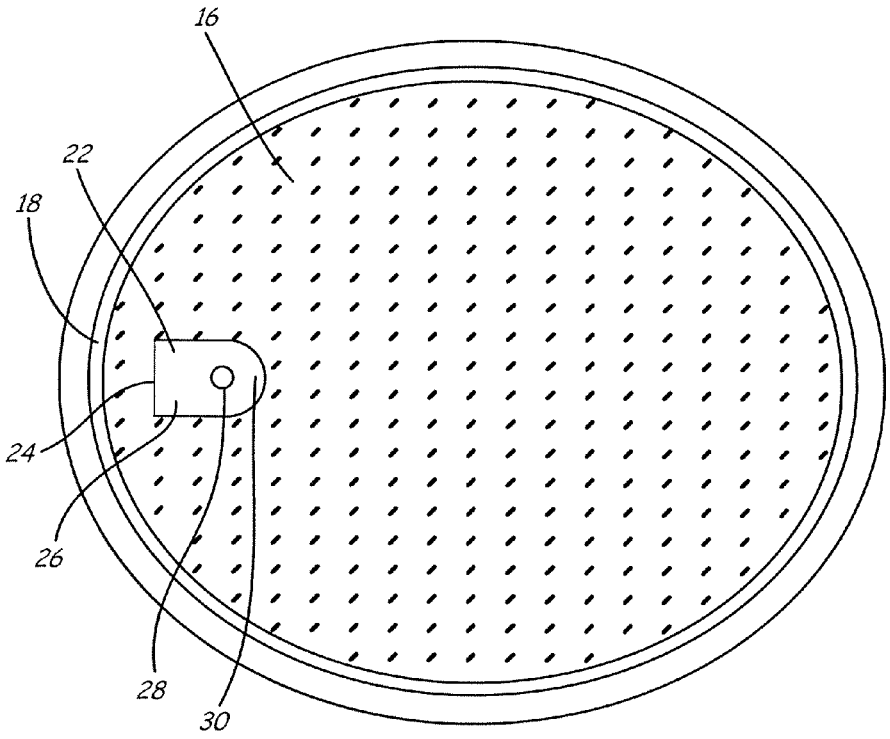
FIG. 2 is a top view of the foil membrane lid of the present invention in a sealed position.

Lid 16 further includes tab 22. Tab 22 is generally fabricated from the same material as lid 16. In a preferred embodiment, tab 22 and lid 16 are fabricated from materials with dead fold capabilities like, for example, aluminum foil. For purposes of the present invention, the term "dead fold" refers to articles made of a malleable material so that they will stay in a given position. With reference to FIG. 2, Tab 22 is bonded to lid 16 at the base 24 of tab 22. This configuration enables the body 26 of tab 22 to move independently of lid 16 in a rotatable fashion with respect to base 24.

In a preferred embodiment, body 26 of tab 22 is fastened to lid 16 at rivet 28. Rivet 28 can include an actual rivet, a mechanical crimp, a thermal weld, or an adhesive weld while remaining within the scope of the invention. In any event, rivet 28 helps keep tab 22 relatively flat against lid 16 to protect tab 22 from damage or inadvertent opening of the container 10 due to snagging or tearing of the tab 22. Rivet 28 also provides a forceful connection between tab 22 and lid 16 which creates a tamper evident seal. Rivet 28 can include a circular, rectangular, triangular, or irregular configuration while remaining within the scope of the invention.

Figure 3:
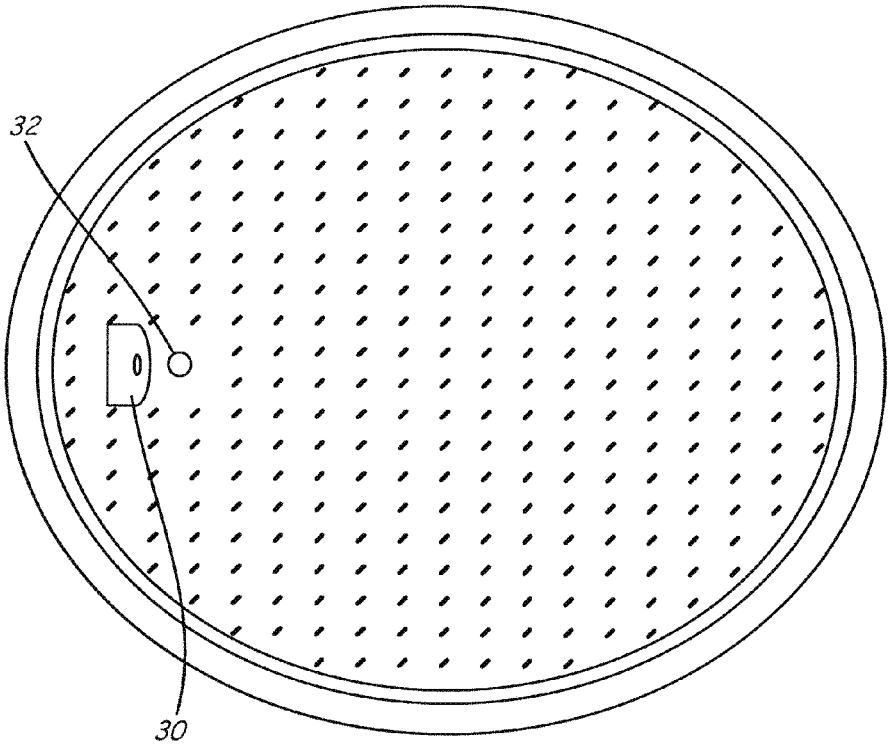
FIG. 3 is a top view of the foil membrane lid of the present invention in a depressurized condition.
Figure 4:
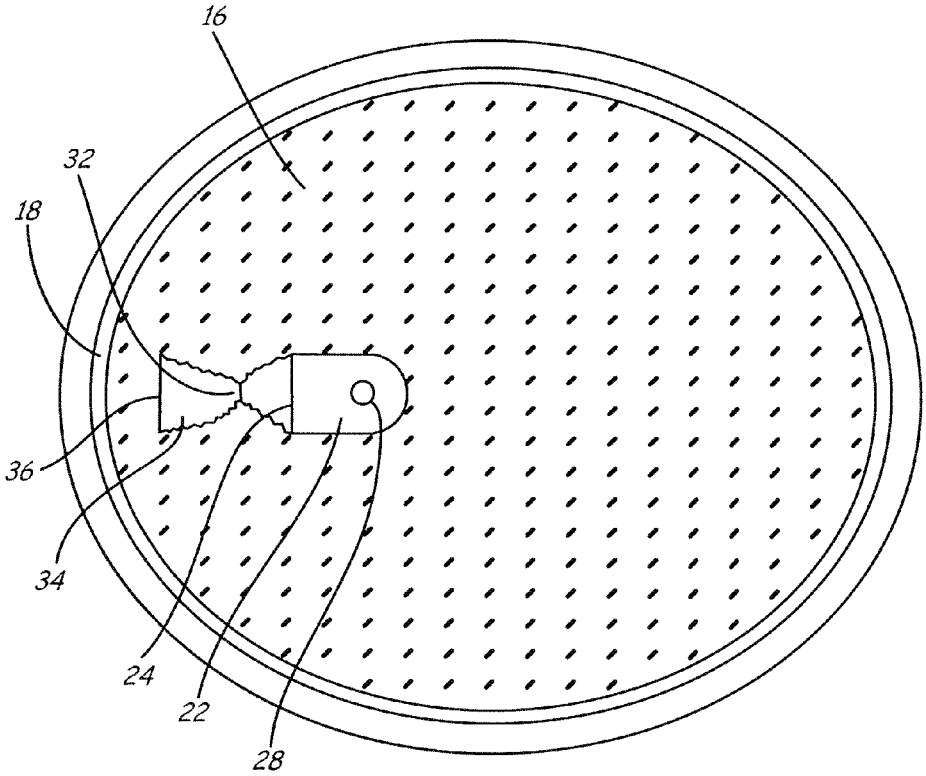
FIG. 4 is a top view of the foil membrane lid of the present invention in a partially opened position.
Figure 5:
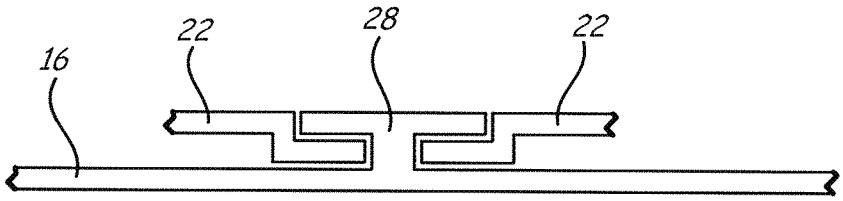
FIG. 5 is a cross-sectional view of the foil membrane lid and tab in a sealed position.

With reference to FIGS. 2-6, the process for opening lid 16 will now be discussed. FIG. 2 illustrates lid 16 in a sealed position. In this position, the body 26 of tab 22 is generally parallel to lid 16. Tab 22 is fastened to lid 16 at base 24 and rivet 28. An alternative embodiment illustrating the interaction between lid 16, tab 22, and rivet 28 is shown in FIG. 5. In this embodiment, rivet 28 is attached to lid 16. A portion of tab 22 extends around and under rivet 28.

Figure 6:
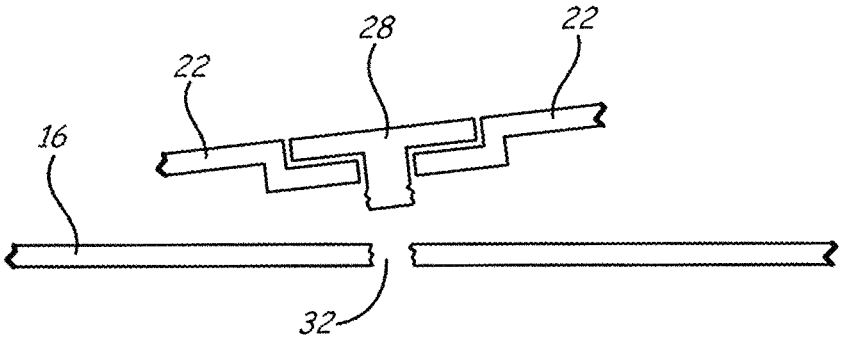
FIG. 6 is a cross-sectional view of the foil membrane lid and tab in a depressurized condition.

When opening container 10, a user grasps end 30 of tab 22 and pulls end 30 away from lid 16 with sufficient force to separate rivet 28 from lid 16. When rivet 28 is separated from lid 16 a hole 32 is formed in lid 16 as shown in FIGS. 3 and 6. If the contents of container 10 are exposed to a different pressure than the atmospheric pressure, the pressure may be equalized through hole 32. For this reason, rivet 28 should be large enough to create a hole 32 that gas can pass through. In some circumstances, there is a tendency for the contents of container to splash through hole 32. If splashing occurs, the surface of tab 22 acts as a splash guard to reduce the chance that the contents of container 10 will contact the user.

Figure 7:
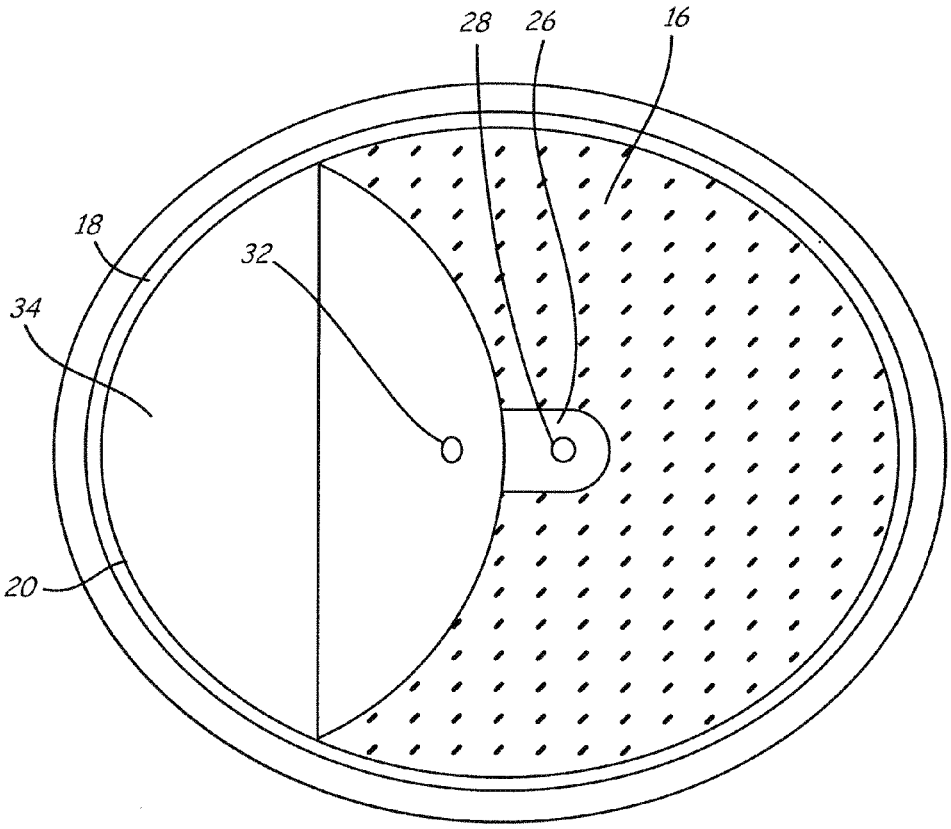
FIG. 7 is a top view of an alternative embodiment of the foil membrane lid in a partially opened position.

The process for creating a larger opening in lid 16 will now be discussed with reference to FIG. 4. As the end 30 of tab 22 is pulled away from the lid 16 the base 24 separates from the lid 16 at tear 36. As the user pulls the tab 22 away from the lid 16 or, alternatively, in a direction away from tear 36, opening 34 is created. The user may continue pulling on tab 22 to create the desired size opening 34. Tab 22 can be configured to pull lid 16 away from end blank 18 along score 20 as shown in FIG. 7. In this embodiment, a larger opening 34 is created as lid 16 pulls away from end blank 18 about the perimeter of container 10.

The invention as depicted and described herein may be embodied in other specific forms without departing from the spirit or essential attributes thereof, and it is, therefore, desired that the embodiments be considered in all respects as illustrative and not restrictive. Similarly, the above-described methods are illustrative sequential processes and are not intended to limit the methods of the invention to those specifically defined herein. It is envisioned that various depicted steps can be performed in differing substantive and sequential order. In addition, various unspecified steps and procedures can be performed in between those steps described herein without deviating from the spirit and scope of the invention. Reference should be made to the appended claims rather than to the foregoing description to indicate the scope of the invention.

The invention claimed is:

1. A closure for a container, the closure comprising:

a lid that is attachable to the container to define a sealed space within the container, wherein the lid generally defines a plane and is bordered by an end blank that is bondable to a container perimeter, the lid being separated from the end blank by a peripheral score line that defines a periphery of the lid and surrounds the lid;

a unitary, one piece tab including a base, an end opposite the base, and a rivet disposed between the base and the end, wherein the tab defines a longitudinal axis extending between the base and the end opposite the base, wherein the rivet comprises a pin extending through the tab at a location between the base and the end opposite the base;

wherein the tab is fastened to the lid at the base of the tab and also fastened to the lid by extending the pin through the tab to be attached to the lid at a location between the base of the tab and the end opposite the base and further wherein the longitudinal axis of the tab is generally parallel to the plane of the lid, and wherein a body of the tab extends away from the base of the tab and the base of the tab, the body of the tab and the rivet are located within the periphery of the lid as defined by the peripheral score line and wherein the base of tab is located at an end of the tab opposing the end opposite the base and a body of the tab does not extend beyond the base of the tab in a direction away from the end opposite the base enabling the tab to rotate about the base, wherein lifting the tab rotates the tab about the base and pulls the rivet away from the lid thereby forming a first hole through the lid for venting the sealed space and further wherein lifting the tab angles the tab such that the longitudinal axis of the tab is transverse to the plane of the lid, and further wherein angling the tab transverse to the lid breaks the peripheral score line and allows the tab to be pulled to apply a pull force to the angled tab transverse to and away from the plane of the lid to at least partially separate the lid from the end blank at the peripheral score line such that the lid can be at least partially removed from the container for accessing the sealed space.

2. The closure of claim 1, wherein the lid is fabricated from a material having dead fold capabilities.

3. The closure of claim 1, wherein the rivet is disposed at the midpoint of the tab.

4. The closure of claim 1, wherein the rivet comprises a pin inserted through aligned portions of the tab and the lid to firmly fix the tab to the lid.

5. The closure of claim 1, wherein the second hole is formed by pulling the tab to separate the lid from the closure.

6. The closure of claim 2, wherein the lid is fabricated from a foil material.

7. The closure of claim 6, wherein the tab is fabricated from a foil material.

8. A vessel for a food product comprising:

a container having a sidewall and a bottom; a lid configured to attach to the container, thereby forming a seal and defining a sealed space within the container, wherein the lid generally defines a plane and is bordered by an end blank that is bondable to a container perimeter, the lid being separated from the end blank by a peripheral score line that defines a periphery of the lid and surrounds the lid;

a unitary, one piece tab including a base, an end opposite the base, and a rivet disposed between the base and the end, wherein the tab defines a longitudinal axis extending between the base and the end opposite the base, wherein the rivet comprises a pin extending through the tab at a location between the base and the end opposite the base;

wherein the tab is fastened to the lid at the base of the tab and also fastened to the lid by extending the pin through the tab to be attached to the lid at the location between the base of the tab and the end opposite the base and further wherein the longitudinal axis of the tab is generally parallel to the plane of the lid, and wherein a body of the tab extends away from the base of the tab and the base of the tab, the body of the tab and the rivet are located within the periphery of the lid as defined by the peripheral score line and wherein the base of tab is located at an end of the tab opposing the end opposite the base and a body of the tab does not extend beyond the base of the tab in a direction away from the end opposite the base enabling the tab to rotate about the base, wherein lifting the tab rotates the tab about the base and pulls the rivet away from the lid thereby forming a first hole through the lid, further wherein lifting the tab angles the tab such that the longitudinal axis of the tab is transverse to the plane of the lid thereby breaking the peripheral score line and allowing the tab to be pulled to apply a pull force to the angled tab transverse to and away from the plane of the lid to at least partially separate the lid from the end blank at the peripheral score line such that the lid can be at least partially removed from the container for accessing the sealed space.

9. The vessel of claim 8, further comprising an end blank disposed about the sidewall of the container, wherein the lid is attached to the container at the end blank.

10. The vessel of claim 8, wherein the lid is fabricated from a material having dead fold capabilities.

11. The vessel of claim 8, wherein the rivet comprises a pin inserted through aligned portions of the tab and the lid to firmly fix the tab to the lid.

12. The closure of claim 8, wherein the second hole is formed by pulling the tab to separate the lid from the closure.

13. A method of preparing a package containing a food product utilizing the closure for the container constructed in accordance with claim 1, the method comprising:

filling the container with the food product; and hermetically sealing the lid to the container to establish a vessel.

14. The method of claim 13, further comprising the step of heating the vessel.

15. The method of claim 14, further comprising the step of cooling the vessel.

* * * * *